United States Patent [19]

Clemente

[11] Patent Number: 4,687,038

[45] Date of Patent: Aug. 18, 1987

[54] BLIND CONSTRUCTION

[75] Inventor: Ralph Clemente, Maywood, N.J.

[73] Assignee: Coronet Industries, Inc., Atlanta, Ga.

[21] Appl. No.: 562,532

[22] Filed: Dec. 19, 1983

[51] Int. Cl.[4] ..... A47H 3/08; E06B 9/262

[52] U.S. Cl. ..... 160/84 R; 160/279

[58] Field of Search ..... 160/84 R, 279; 49/396, 49/352; 267/177

[56] References Cited

U.S. PATENT DOCUMENTS

| | | | |
|---|---|---|---|
| 560,133 | 5/1896 | Emery | 160/279 |
| 824,772 | 7/1906 | Yarger | 267/177 |
| 1,289,281 | 12/1918 | Shaft | 160/84 R |
| 2,681,823 | 6/1954 | Gaisman | 267/177 |
| 3,946,788 | 3/1976 | van Muyen | 160/84 |
| 4,202,395 | 5/1980 | Heck | 160/84 R |
| 4,212,341 | 7/1980 | Fisher | 160/84 R |
| 4,473,101 | 9/1984 | Langeler | 160/84 R |
| 4,557,309 | 12/1985 | Judkins | 160/84 R |

FOREIGN PATENT DOCUMENTS

| | | | |
|---|---|---|---|
| 0015043 | 2/1980 | European Pat. Off. . | |
| 96518 | 12/1983 | European Pat. Off. | 160/166 R |
| 1251507 | 10/1967 | Fed. Rep. of Germany | 160/166 R |

OTHER PUBLICATIONS

"Verosol for Skylights Pleated Blinds for Awkward Situations".

"How to Install Your Gravity Pull 100 Series Verosol SkyShade".

"How to Measure for Your Gravity Pull 100 Series Verosol SkyShade".

*Primary Examiner*—Ramon S. Britts

*Assistant Examiner*—Cherney S. Lieberman

*Attorney, Agent, or Firm*—Fleit, Jacobson, Cohn & Price

[57] ABSTRACT

A pleated fabric is connected between an upper fixed sill and a movable sill. The movable sill is between the upper fixed sill and a lower fixed sill. Two string loops are resiliently secured to the sills and slidably frictionally engaged with the movable sill symmetrical relative to the sills and to a central axis parallel to the direction of movement of the movable sill. The tension in the strings is adjustably set by a single tension spring and a turnbuckle connected between and to the loops. The friction engagement of the strings to the movable sill is set to a friction load having a value which provides smooth operation and tends to keep the movable sill in place at whatever location the sill is moved to regardless the blind orientation relative to gravity.

8 Claims, 4 Drawing Figures

Fig. 4
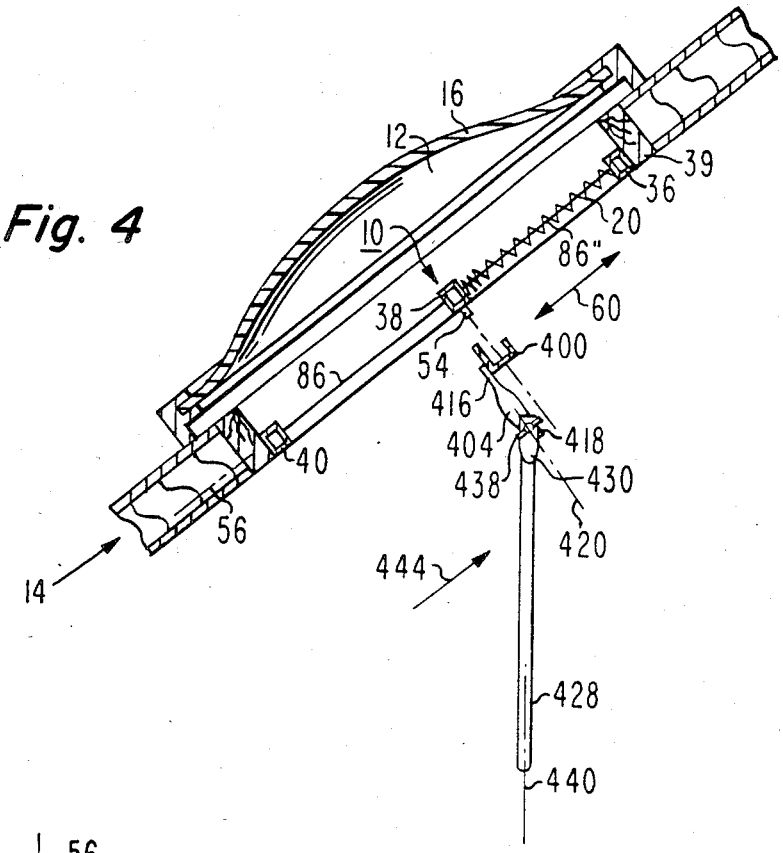
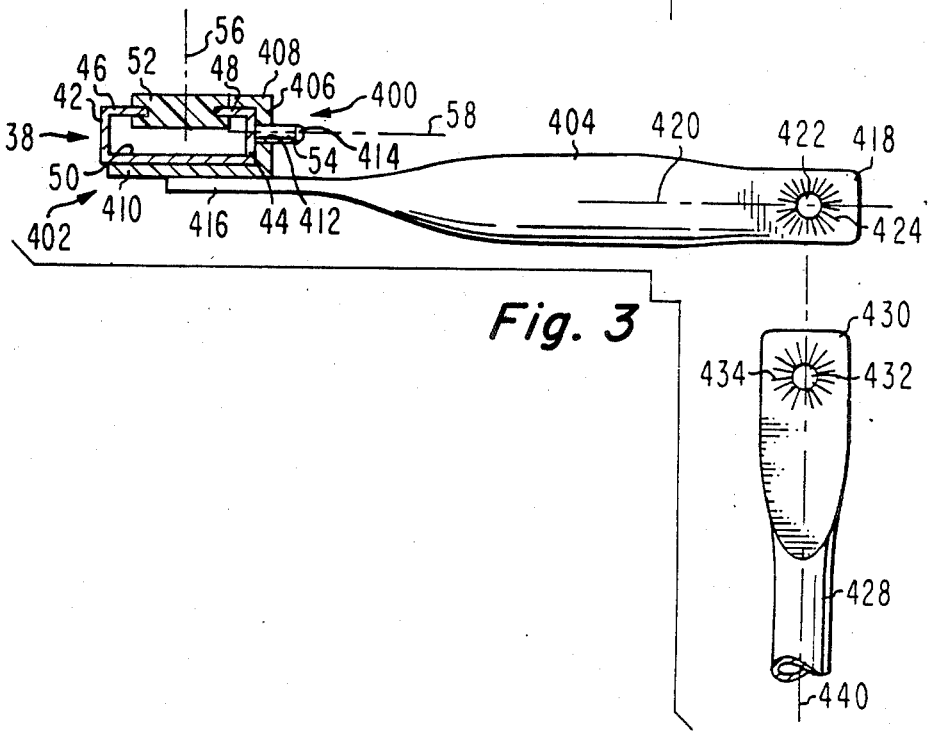
Fig. 3

BLIND CONSTRUCTION

This invention relates to a window blind structure including friction restraining means for retaining the slats in a given orientation.

Of interest is copending application, entitled "Blind Structure Including Remote Slat Moving Means," by the present inventor, Ser. No. 562,531, filed concurrently herewith and assigned to the same assignee as the present invention.

Pleated blind structures include a relatively stiff pleated fabric which permit one end of the fabric to be moved relative to the other end. This movement folds the pleats or slats one upon the other to either open a window opening for light transmission therethrough or to unfold the pleats and close the window opening for reducing or eliminating light transmission through the window. U.S. Pat. No. 3,946,788 discloses a foldable curtain screen or blind construction and a method for producing a curtain blind construction employing a pleated fabric. An improvement of the pleated fabric blind construction is disclosed in European Pat. No. 0,015,043. This patent discloses friction means for retaining the pleated fabric between fully extended and fully retracted positions.

The disclosed blind structure includes an upper sill, a lower sill and a movable sill. The pleated fabric is secured to the upper and movable sills. The upper and lower sills are secured to opposite sides of the window opening. The movable sill is displaced toward the upper sill to open the window opening, stacking or folding the slats one upon the other. A knob or other handle means is attached to the movable sill to facilitate manually moving the sill. However, the disclosed system tends to employ multiple components which add cost to the assembly and the movable sill does not always move smoothly and easily.

A blind construction according to the present invention comprises first, second, and third parallel sills. A plurality of slats are coupled to and between the first and third sills. First and second spaced string loops are engaged with the slats and sills symmetrically with respect to a central axis normal to the sills. The third sill is movable between the first and second sills along the axis and slidably, frictionally engaged with the loops. Tension adjustment means is connected between and to the loops at one of the first and second sills for setting the tension on both loops to any desired value in a range of values to thereby symmetrically set the friction between the loops and the third sill.

In the drawings:

FIG. 3 is a sectional elevation view of a remote slat moving means portion which can be used in the embodiment of FIG. 1; and FIG. 4 is a sectional elevation view through the embodiment of FIG. 1.

Figure 1:
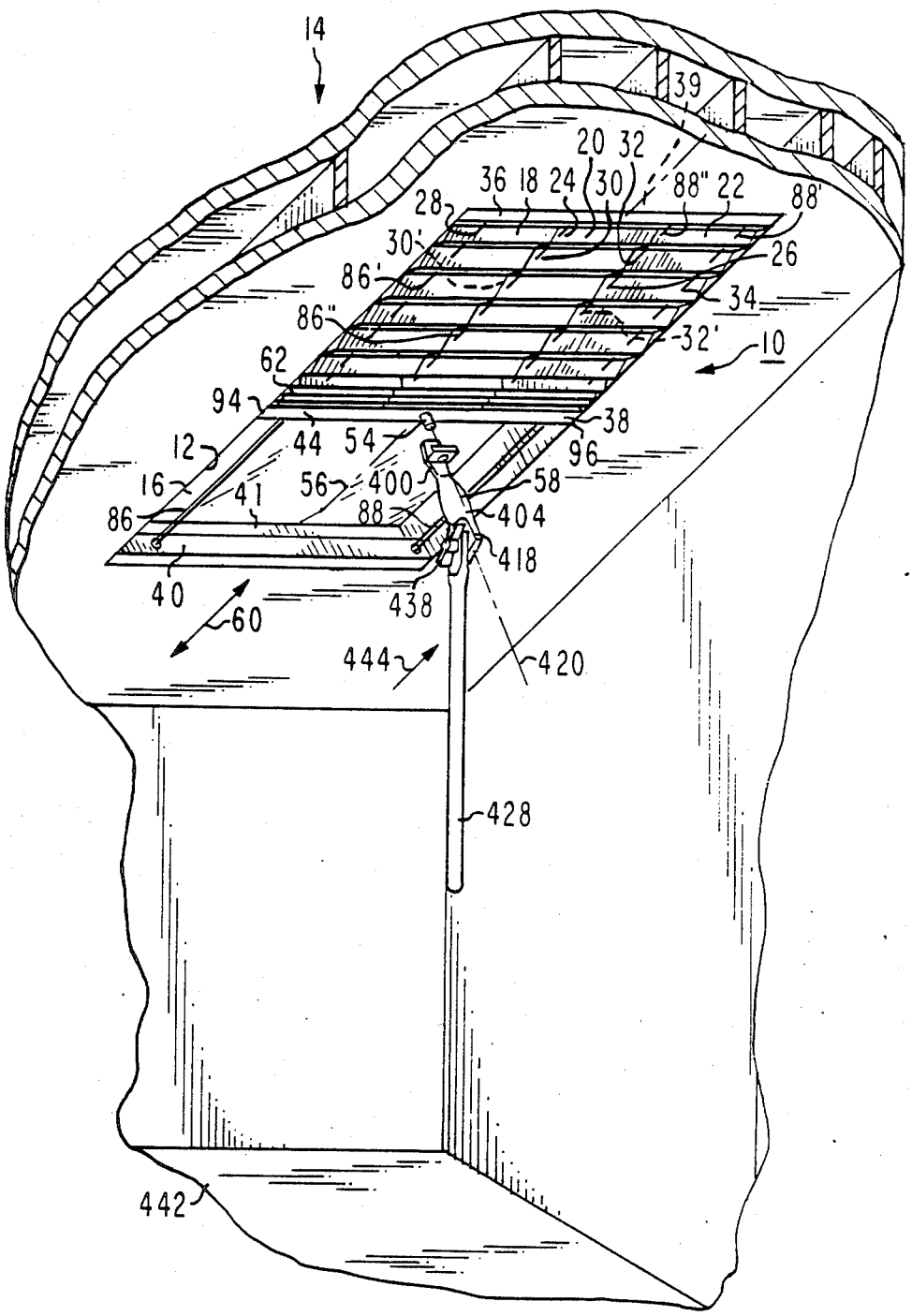
FIG. 1 is a perspective view of a skylight installation of a blind structure in accordance with one embodiment of the present invention.

In FIG. 1, blind structure 10 is installed in a rectangular opening 12 formed in a roof 14 of a building. The opening 12 is covered by a skylight assembly 16. Blind structure 10 is constructed somewhat similar to the general construction, except as modified herein, as described in the aforementioned U.S. Pat. No. 3,946,788 and European Pat. No. 0,015,043, which are incorporated herein by reference. In somewhat similar fashion as disclosed in the aforementioned U.S. patent, the blind structure 10 may comprise a plurality of web portions, for example, portions 18, 20, and 22 which loosely overlap each other at overlapping portions 24 and 26. While three portions are shown herein, more or fewer portions may be used in the alternative. The web portions 18, 20, and 26 may be of equal or different widths and each comprise pleated relatively stiff fabrics. Each pleat forms a blind slat. The slats of portion 18 have two columns of apertures 28, 30', the slats of portion 20 have two columns of apertures 30, 32', and the slats of portion 22 have two columns of apertures 32, 34. Apertures 30, 30' of overlapping portions 18 and 20 are aligned. The apertures 32, 32' of overlapping portions 20 and 22 at 26 are aligned.

One end of the pleated portions 18, 20, and 22 is secured to upper fixed sill 36 and the opposite end is secured to movable sill 38. Lower fixed sill 40 is on a side of movable sill 38 opposite upper sill 36. The upper sill 36 is secured to a header or frame 39 at one end of opening 12 and the lower sill 40 is secured to a footer or frame 41 at the other end of opening 12.

Alternatively, the pleated portions 18, 20, and 22 could be replaced by conventional Venetian blind slats with a tilting mechanism concealed in the upper sill 36.

In FIG. 3, sill 38 comprises a rectangular conduit-like member having a bottom wall 50 and two side walls 42 and 44 from which respective legs 46 and 48 inwardly extend. An elongated thermoplastic sheet member 52 has two channels in respective opposite edges extending along its length which closely engage with and lock to the inwardly facing legs 46 and 48. Member 52 is slid into engagement with legs 46, 48 from an open end of sill 38. In the alternative, legs 46, 48 and member 52 may be an integral member similar to wall 50. Sills 36 and 40 may be constructed similar to sill 38, which construction is representative, except for the inserts to be described below.

The movable sill 38 has a knob-like projection 54 extending perpendicular to wall 44. Projection 54, which may be a right circular cylinder, is centrally positioned between the ends of the sill 38 aligned on axis 56, FIG. 1. Axis 56 is parallel to directions 60 in which sill 38 is moved. Projection 54 has a long axis 58, FIG. 3, which intersects and is perpendicular to axis 56. The axis 58 may be displaced slightly from the axis 56 but is generally close to or on the axis 56. The projection 54 is perpendicular to side wall 44.

By grasping the knob 54 and manually displacing the sill 38 in one of directions 60 toward sill 36 the slats are stacked or folded as at 62 in FIG. 1, to open the blind 10 to ambient light. Displacing the sill 38 towards sill 40 in the opposite direction unfolds the slats to thereby close the blind and preclude transmission of light through the opening 12.

Figure 2:
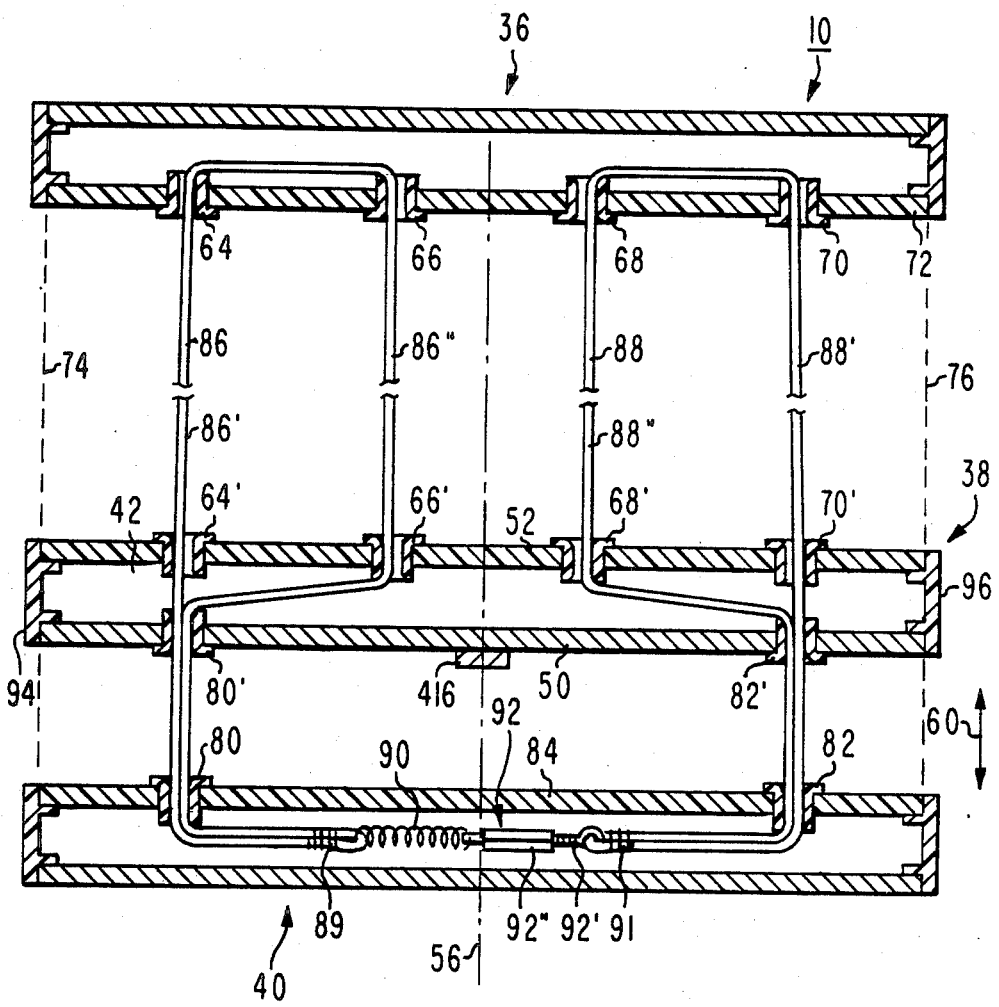
FIG. 2 is a fragmented sectional view of the blind structure of FIG. 1 illustrating the friction means.

In FIG. 2, the blind structure 10 includes friction means for retaining the movable sill 38 in any given position between the upper sill 36 and the lower sill 40. The upper sill 36 wall 72 (which may be similar to sheet member 52, FIG. 3*a*) has a plurality of like apertured inserts 64, 66, 68, and 70 which may be made of polyvinylchloride (PVC) or acrylonitrile-butadiene-styrene (ABS). The inserts 64 and 70 are closely spaced to the respective edges of the pleated fabric represented by dashed lines 74 and 76. The inserts 66 and 68 may be equally spaced between inserts 64 and 70. The insert 66 is aligned with the column of apertures 30, 30' in portions 18, 20, FIG. 1. Insert 68 is aligned with the column of apertures 32, 32' in portions 20, 22.

Lower sill 40 wall 84 (which may be similar to sheet member 52) has a pair of inserts 80 and 82 which are aligned with respective inserts 64 and 70 in a direction parallel to central axis 56. Member 52 of sill 38 has four inserts 64', 66', 68', and 70' in alignment with respective inserts 64, 66, 68, 70 of upper sill 36 in a direction parallel to axis 56. Bottom wall 50 of sill member 38 has a pair of inserts 80' and 82' aligned with the respective inserts 80 and 82 of sill 40. Inserts 64, 64', 80, 80' are aligned with the column of apertures 28 in portion 18. Inserts 70, 70', 82', 82 are aligned with the column of apertures 34. All of the inserts 64, 66, 68, 70, and so forth, may be made of the same material.

The inserts are apertured flanged grommet-like members which snap fit into apertures in the corresponding walls of the respective sills. The inserts have central apertures with rounded edges for receiving string loops 86 and 88. Loop 86 is a closed loop formed by a string which passes through the apertures of inserts 64, 66, 64', 66', 80' and 80. One end 89 of loop 86 is connected to one end of tension spring 90. String loop 88 forms a closed loop formed by a string which passes through inserts 68, 70, 68', 70', 82, and 82'. One end 91 of loop 88 is connected to the other end of tension spring 90 by a turnbuckle 92. String portion 86' of loop 86 passes through inserts 64, 64', 80', and 80. String portion 86'' of loop 86 passes through inserts 66, 66', and 80. Portions 86' and 86'' both pass through inserts 80', 80 to form end 89. End 91 of portion 88 is formed similarly. That is, portions 88', 88'' both pass through inserts 82', 82 to form end 91. A different string construction is shown in the European Pat. No. 0,015,043, mentioned in the introductory portion. That construction, however, uses a plurality of springs which would require matching of spring constants to provide uniform loop tension and, also, is not readily adjustable for setting the tension in the string loops.

The string construction of the present invention provides settable friction holding forces on the movable sill 38 at the respective inserts 80', 82', 66', and 68' and substantially the same tension on both string loops 86, 88. Loop portion 86'' bends over and around inserts 80', 66', and loop portion 88'' bends over and around inserts 68' and 82'. This bending configuration creates friction interface surfaces between the respective inserts and the strings. The tension on the strings due to the tension set on spring 90 induces a friction load at the friction surfaces. The turnbuckle 92 may be adjusted to set and fine tune the tension on the string loops and, thus, the amount of friction between the string loops 86, 88 and the sill 38 inserts. Turnbuckle 92 comprises a bolt 92' screwed to a nut 92''. Bolt 92' is connected to loop end 91 and nut 92'' is connected to one end of spring 90. Turning bolt 92' relative to nut 92'' changes the load on spring 90 by lengthening or shortening the spring, thus changing the tension on loops 86, 88. This spring load is symmetrical on loops 86 and 88 since spring 90 is connected to and between the loops at symmetrically positioned ends. Thus, a single spring is used in this construction.

Loop portion 86' passes through slat apertures 28 and loop portion 86'' passes through slat apertures 30 and 30. Similarly, with respect to loop 88, portion 88'' passes through slat apertures 32, 32' and portion 88' passes through slat apertures 34, FIG. 1.

When the sill 38 is moved in directions 60, FIG. 2, it slides over the strings passing through its respective inserts and, due to the friction between the string loop and the inserts the sill tends to remain in place wherever pushed or moved. The slats portions 18, 20, and 22 at 62 loosely slide over the loop portions as the sill 38 is moved. The symmetry of the friction forces relative to axis 56 and the aligned orientation of the inserts permit smooth displacement of sill 38 in directions 60 without skewing in response to a sill moving force on axis 56.

Projection 54, FIGS. 1, 3*a*, and 4 is centrally located on axis 56. Axis 56 is centrally located between the string loops 86 and 88. A force applied to the projection 54 in directions 60, FIG. 2, tends to displace the sill 38 parallel to the upper and lower sills 36 and 40, respectively, in response to the symmetrical friction force load on sill 38 caused by the string loops. Any tendency to tilt the sill 38 relative to the sills 36 and 40 by an off-center or misaligned pushing or applied force vector tends to skew the sill 38 relative to the other sills. That is, the symmetrical sliding friction loads between the strings and the movable sill 38 tend to retain the sill in the tilted orientation. Tilting of sill 38 can be a problem when remotely moved.

In FIG. 3, apparatus 400, described in more detail in the aformentioned copending application is releasably attached to projection 54 and sill 38. Apparatus 400, FIG. 3, grasps sill 38 and can accurately transmit a remotely applied force vector to sill 38 to move it in the desired direction, e.g., directions 60.

Apparatus 400 includes channel member 402 and connecting link 404. Member 402 comprises a base wall 406 and two side walls or legs 408 and 410. Leg 410 extends from base wall 406 a greater extent than the leg 408. Centrally disposed within the base wall 406 is aperture 412. Aperture 412 has a diameter slightly larger than the diameter of projection 54 for closely receiving projection 54 on axis 58. To facilitate entry of the projection 54 into the aperture 412, end 414 of projection 54 may be conical or otherwise tapered. The inner surfaces of legs 408 and 410 are dimensioned to closely receive the corresponding side wall 44 of sill 38. The projection 54 accurately aligns member 402 on axis 58 and on vertical axis 56.

In FIG. 3, link 404 comprises a hollow aluminum tubular member which is flattened at one end to form a flange 416 and flattened at the other end to form a second flange 418. The planes of flanges 416 and 418 are perpendicular. Flange 416 is welded or otherwise secured to the underside of leg 410, member 400. The link 404 has a longitudinal axis 420 which may be parallel to axis 58. The flange 418 has an aperture 422 surrounded by radial serrations 424.

In FIG. 3, pole 428 has a flange 430 formed at one end having an aperture 432 surrounded by radial serrations 434 on both sides of the flange 430. Flange 430 is attached to flange 418 by a bolt and a wing nut (not shown). The pole 428 has a long axis 440 which passes through the center of aperture 432. Aperture 422 is aligned centrally with axis 420 of the link member 404. Axis 440 of pole 428 may be aligned at any angle with respect to the axis 420 determined by aligned serrations 422, 434 and thus at any desired angle with respect to axis 58.

In FIG. 4, the long axis 440 of pole 428 may be vertically oriented, whereas the axis 420 of the link 404 is perpendicular to the plane of the blind structure 10 represented by axis 56. The link 404 and pole 428 form an integral rigid member. Therefore, a force applied to the pole 428 by an individual standing on the floor 442, FIG. 1, for example, in direction 444 parallel to axis 56, is transmitted by apparatus 400 substantially in the same direction and amplitude to the sill 38. Further, that force vector is applied in directions 60 parallel to and along axis 56 due to the alignment of the apparatus 400 on the axis 56 as described above. Thus, the force is transmitted to sill 38 parallel to the axis 56 to substantially avoid skewing of the sill 38 during its displacement. Unless the force vector is applied substantially on the axis 56, that force vector can create a torque relative to the axis 56 since the string loops 86 and 88 and the friction loads that they induce when the sill 38 is moved are symmetrical about axis 56. That torque would tend to skew or otherwise tilt the sill 38 relative to axis 56. Therefore, the force applied to pole 428 is applied to sill 38 on axis 56 or as close as possible to the axis 56 to substantially avoid such skewing and tilting. The construction of the apparatus 400, link 404, and pole 428 in conjunction with the projection 54 and its location on the sill 38 eliminate the need for using pull strings or other additional apparatus for moving the sill 38.

What is claimed is:

1. A blind construction comprising:

first, second, and third parallel sills;

a plurality of slats coupled to and between said first and third sills;

first and second spaced string loops engaged with said slats and sills symmetrical to a central axis normal to said sills, said third sill being movable between said first and second sills along said axis and slidably frictionally engaged with said loops at locations symmetrical relative to said axis; and tension adjustment means connected to said loops at one of said first and second sills for simultaneously setting the tension on both said loops to the same desired value in a range of values to thereby symmetrically set the friction between said loops and said third sill wherein said first, second, and third sills include first and second sets of hollow inserts aligned in corresponding first and second columns parallel to said axis, said first and third sills include third and fourth sets of hollow inserts aligned in third and fourth columns parallel to said axis, the inserts of said third set facing one another, the inserts of the fourth set facing one another; one of said string loops passing through said first and third sets of inserts, and the other string loop passing through the second and fourth sets of inserts.

2. The construction of claim 1 wherein said tension adjustment means includes a tension spring having first and second ends, one end of said spring being connected to one of said loops; and a turnbuckle connected between the other end of the tension spring and the other of said loops.

3. The construction of claim 1 wherein said slats include a pleated fabric.

4. The construction of claim 1 wherein said tension adjustment means is located between an end insert of each column of said first and second sets of inserts.

5. The construction of claim 1 wherein said tension adjustment means includes a tension spring connected at one end to one of said loops; and spacing adjust means connected between the other end of the spring and the other of said loops to adjustably set the length of and thus a tensile load on said spring.

6. In a blind construction, the combination comprising:

first, second, and third sills extending normal to a given axis centrally located relative to the ends of said sills;

said first sill having a first row of apertures extending normal to and symmetrical relative to said axis;

said third sill comprising first and second parallel spaced walls, said first wall having a second row of at least four apertures each aperture of which being aligned with and facing a different one of said first sill apertures forming a plurality of aperture columns, said second wall having a first pair of apertures, each aperture of the pair being aligned with an aperture column at opposite ends of said sills;

said second sill having a second pair of apertures aligned with and facing said first pair of apertures in said end columns;

a first string loop having a first portion passing through the apertures in one column, and a second portion passing through the apertures in the next adjacent aperture column and through the respective apertures of said first and second aperture pairs lying in said one end column;

a second string loop having a first portion passing through the apertures in the other end column, and a second portion passing through the apertures in the next adjacent aperture column and through the other respective aperture of said first and second pair of apertures; and tension adjustment means connected to said loops for simultaneously setting substantially equal tension on both said loops.

7. The construction of claim 6 wherein said rows each comprise four apertures, the central pair of apertures of each row being aligned in a pair of middle columns, one of said loops passing through one of said middle columns and the other of said loops passing through the other of said middle columns.

8. The construction of claim 6 further including a pleated apertured fabric forming a plurality of slats connected to and between the first and second sills, said loops passing through the apertures of said fabric slat structure.

* * * * *